US010074914B2

(12) United States Patent
Lappoehn

(10) Patent No.: US 10,074,914 B2
(45) Date of Patent: Sep. 11, 2018

(54) PLUG CONNECTOR

(71) Applicant: ERNI Production GmbH & Co. KG, Adelberg (DE)

(72) Inventor: Juergen Lappoehn, Gammelshausen (DE)

(73) Assignee: ERNI Production GmbH & Co. KG, Adelberg (DE)

( * ) Notice: Subject to any disclaimer, the term of this patent is extended or adjusted under 35 U.S.C. 154(b) by 0 days.

(21) Appl. No.: 15/535,778

(22) PCT Filed: Dec. 15, 2015

(86) PCT No.: PCT/DE2015/100536
§ 371 (c)(1),
(2) Date: Jun. 14, 2017

(87) PCT Pub. No.: WO2016/095907
PCT Pub. Date: Jun. 23, 2016

(65) Prior Publication Data

US 2017/0373405 A1 Dec. 28, 2017

(30) Foreign Application Priority Data

Dec. 15, 2014 (DE) ..... 20 2014 106 058 U

(51) Int. Cl.
*H01R 4/24* (2018.01)
*H01R 4/2433* (2018.01)
(Continued)

(52) U.S. Cl.
CPC ..... *H01R 4/2433* (2013.01); *H01R 12/675* (2013.01); *H01R 13/112* (2013.01);
(Continued)

(58) Field of Classification Search
CPC .... H01R 13/58; H01R 13/112; H01R 13/506; H01R 13/582; H01R 4/2433;
(Continued)

(56) References Cited

U.S. PATENT DOCUMENTS 3,808,582 A 4/1974 Aldridge et al.
4,040,704 A * 8/1977 Huber ..... H01R 12/675 439/400
(Continued)

FOREIGN PATENT DOCUMENTS

DE 201 08 895 U1 12/2001
DE 10 2006 045 808 A1 4/2008
(Continued)

OTHER PUBLICATIONS

International Search Report of PCT/DE2015/100536, dated Apr. 4, 2016.

*Primary Examiner* — Abdullah Riyami
*Assistant Examiner* — Vladimir Imas
(74) *Attorney, Agent, or Firm* — Collard & Roe, P.C.

(57) ABSTRACT

A plug includes at least one spring or blade contact element which is disposed in a housing and is connected in an electrically conducting manner to at least one insulation displacement contact that contacts and secures at least one insulated single-core cable. The at least one insulation displacement contact extends at a 90° angle from the spring or blade contact element in the plug-in direction of the spring or blade contact element in such a way that the at least one insulated single-core cable extending in the plug-in direction is contacted and secured by an insulation displacement contact.

8 Claims, 4 Drawing Sheets

(51) Int. Cl.

| | |
|---|---|
| ***H01R 12/67*** | (2011.01) |
| ***H01R 13/506*** | (2006.01) |
| ***H01R 13/58*** | (2006.01) |
| ***H01R 43/16*** | (2006.01) |
| ***H01R 13/11*** | (2006.01) |

(52) U.S. Cl.
CPC ..... *H01R 13/506* (2013.01); *H01R 13/582* (2013.01); *H01R 43/16* (2013.01)

(58) Field of Classification Search
CPC .. H01R 4/2429; H01R 4/2466; H01R 4/2462; H01R 4/2458; H01R 12/675; H01R 43/16
USPC ..... 439/401, 398
See application file for complete search history.

(56) References Cited

U.S. PATENT DOCUMENTS 4,277,124 A * 7/1981 Loose ..... H01R 13/5808 439/398
4,350,404 A * 9/1982 Clark ..... H01R 4/2462 439/398
4,354,719 A * 10/1982 Weidler ..... H01R 4/2462 439/398
4,385,794 A * 5/1983 Lucius ..... H01R 4/2466 439/399
4,439,001 A * 3/1984 Curley ..... H01R 12/675 439/404
4,743,208 A 5/1988 Weisenburger
5,076,801 A 12/1991 Schroll
5,435,757 A * 7/1995 Fedder ..... H01R 13/11 439/686
5,622,515 A * 4/1997 Hotea ..... H01R 4/2454 29/884
5,915,989 A * 6/1999 Adriaenssens ..... H05K 1/0228 439/404
6,371,321 B1 4/2002 Lee
6,761,589 B2 * 7/2004 Venditti ..... H01R 13/506 439/596
6,979,222 B2 * 12/2005 Comini ..... H01R 4/2458 439/395
7,201,601 B2 * 4/2007 Lappohn ..... H01R 4/2433 439/404
7,407,406 B2 * 8/2008 Arlitt ..... H01R 4/24 439/404
7,503,797 B2 3/2009 Lappoehn
7,503,799 B2 * 3/2009 Keith ..... H01R 13/506 439/417
7,901,231 B2 * 3/2011 Hwang ..... H01R 4/245 439/235
7,938,673 B2 * 5/2011 Hetzer ..... H01R 4/2429 439/404
8,162,679 B2 * 4/2012 Ko ..... H01R 4/2454 439/401
8,277,262 B2 * 10/2012 Busse ..... H01R 12/727 439/719
9,444,159 B2 * 9/2016 Lappoehn ..... H01R 4/2433
9,692,161 B2 * 6/2017 Lindkamp ..... H01R 4/2433
2006/0199423 A1 9/2006 Yamanashi et al.

FOREIGN PATENT DOCUMENTS

| | | | |
|---|---|---|---|
| DE | 20 2012 006 976 | U1 | 9/2012 |
| EP | 0 835 535 | B1 | 12/1999 |
| EP | 1 575 136 | A2 | 9/2005 |
| EP | 2 290 749 | A1 | 3/2011 |
| EP | 2 698 873 | A1 | 2/2014 |
| EP | 2 747 208 | A1 | 6/2014 |
| JP | 2000-323196 | A | 11/2000 |

* cited by examiner

PLUG CONNECTOR

CROSS REFERENCE TO RELATED APPLICATIONS

This application is the National Stage of PCT/DE2015/100536 filed on Dec. 15, 2015, which claims priority under 35 U.S.C. § 119 of German Application No. 20 2014 106 058.8 filed on Dec. 15, 2014, the disclosures of which are incorporated by reference. The international application under PCT article 21(2) was not published in English.

The invention relates to a plug connector having at least one spring or blade contact element arranged in a housing, said contact element being connected in an electrically conductive manner to at least one insulation displacement contact which contacts and fixes at least one single-core, insulated cable. The invention furthermore relates to a method for the manufacture of a spring or blade contact element for such a plug connector.

PRIOR ART

In particular in the field of automotive technology, plug connectors are known, which are provided for a plurality of single-core, insulated cables. All cables are, in this regard, separate within the plug connector, for example fixed and contacted with insulation displacement contacts.

Such a plug connector emerges, for example, from DE 20 2012 006 976 U1. In the case of this plug connector, the spring or blade contact elements are arranged at a right angle to the single-core, insulated cables. Such an angled arrangement of the plug contacts relative to the single-core, insulated cable is common.

A plug connector with strain relief emerges from DE 10 2006 045 808 A1, wherein the plug contacts are also arranged at an angle of approximately 90° and which serves for contacting a plurality of single-core, insulated cables which are connected to one another as flat ribbon cables. In the case of this plug connector, clamping elements are provided in the housing which clamp cable insulation by deforming the insulation and even partially penetrating into the insulation. These clamping elements are formed as inelastic clamping elements on the plastic housing.

Contacts for a plurality of single-core, insulated cables also emerge from U.S. Pat. No. 3,808,582 and from U.S. Pat. No. 5,076,801. The contact takes place, in this regard, in a partially cumbersome manner. These contact solutions are also not readily usable in plug connectors.

A contact element emerges from US 2006/0199423 which is formed as a sheet metal element, on one end of which a spring contact element is arranged and on the other end of which an insulation displacement contact bent by 90° is arranged. This formation enables the arrangement of a single insulation displacement contact on one end of the sheet metal element.

A connection element emerges from EP 2 747 208 A1, in which the insulation displacement contact is fastened as a separate component on a sheet metal element forming a blade contact element for example.

Plug elements having insulation displacement contacts furthermore emerge from EP 2 290 749 A1, DE 201 08 895 U1, JP 2000323196 A and EP 0 835 535 B1.

U.S. Pat. No. 4,743,208 discloses a contact element which is formed as a spring contact element having insulation displacement contacts and clamping elements. This contact element requires a costly manufacturing process which comprises several bending processes. Due to the multiple bend formations, this contact element does not have a very compact design, which, in particular in plug connectors with many contact elements, makes it necessary for the plug connector to have large dimensions.

The object underlying the invention is to develop a plug connector of the type described in the introduction such that a simple and secure contact of single-core, insulated cables, in particular also of a plurality of single-core, insulated cables is possible, wherein the cables should be arranged in the plug connector such that they run in the plug direction, thus not at an angle to the plug direction. In particular, the plug connector should have a compact design and should also be able to be manufactured in an automated and simple manner.

The object is solved by the features indicated in the independent claims.

DISCLOSURE OF THE INVENTION

Advantages of the Invention

The plug connector according to the invention having at least one spring or blade contact element arranged in a housing, said contact element being connected in an electrically conductive manner to at least one insulation displacement contact which contacts and fixes at least one single-core, insulated cable, has at least one insulation displacement contact arranged to be rotated or twisted by 90° in the plug direction of the spring or blade contact element relative to the spring or blade contact element, which enables it to contact and fix the at least one single-core, insulated cable running in the plug direction through an insulation displacement contact. The basic idea of the invention is, in the case of such a plug connector, to rotate the at least one insulation displacement contact by 90° and arrange it in a line with the spring or blade contact elements such that a mutually aligned arrangement of the spring or blade contact elements and of the single-core, insulated cable is achieved. The arrangement additionally allows a simple assembly of a plurality of single-core, insulated cables in a plug connector, as will be explained further below. The insulation displacement contacts are thus rotated about an axis perpendicular to the plug direction. A big advantage here is that the contact elements, i.e. spring or blade contact elements, and the insulation displacement contacts can be manufactured as a single punched part in a punching process and the rotation in the sense of torsion of the insulation displacement contacts takes place after this punching process in such a way that it is twisted to some extent from the plane, which includes the plug direction, until the insulation displacement contacts are arranged in such a way that a single-core cable to be inserted therein runs in the plug direction.

Advantageous configurations of the plug connector are the subject matter of the dependent claims. It is thus, for example, provided that several insulation displacement contacts arranged one behind the other are arranged to be rotated. By means of rotation or torsion of the insulation displacement contacts, several insulation displacement contacts arranged one behind the other can be provided. This is initially enabled by rotating the insulation displacement contacts about an axis perpendicular to the plug direction. The insulation displacement contacts are manufactured one next to the other as punched parts and then each insulation displacement contact is rotated by 90° about an axis perpendicular to the plug direction. In this way, not only insulation displacement contacts, but also, for example, clamping elements or similar can be provided and arranged.

An embodiment provides that, on the side facing away from the spring or blade contact element, a support is arranged integrally connected to said spring or blade contact element, on said support at least one insulation displacement contact is arranged to be rotated. This integral design of the spring or blade contact element and of the insulation displacement contact simplifies not only the manufacture, but is also advantageous with respect to electrical conductivity.

A particularly advantageous configuration makes provision for at least one clamping element to be formed on the support on the side of at least one insulation displacement contact facing away from the at least one spring or blade contact element, said clamping element, in the contacted and fixed state of the at least one single-core, insulated cable, clamping the insulation thereof to form a strain relief. The clamping element is thus part of the electrically conductive spring or blade contact element and of the insulation displacement contact and is also arranged on the support. These clamping elements can be implemented just like the insulation displacement contacts by a rotation or torsion by 90°.

According to an advantageous embodiment, provision is made for a plurality of clamping elements to be arranged one behind the other and clamp the insulation shell of the single-core cable over a long distance.

The whole component made of spring or blade contact elements, insulation displacement contacts and clamping elements can thus be manufactured as a punched part and the insulation displacement contacts and the clamping elements are thus rotated by 90°. This type of manufacture and arrangement has the great advantage that not only several insulation displacement contacts can be arranged one behind the other, but also several clamping elements. In this way, clamping elements arranged in the housing can be dispensed with. In fact, the clamping element is manufactured together with the spring or blade contact, the insulation displacement contact and the support.

In this regard, an advantageous configuration makes provision for the spring or blade contact element, the support, the insulation displacement contact arranged on the support and the clamping element arranged on the support to form a single punched part. The spring or blade contact element, the support, the insulation displacement contact arranged on the support and the clamping element formed on the support are preferably manufactured in a punching step. Subsequently, a rotation of the insulation displacement contact by 90° takes place. Such a manufacturing method can be carried out in large numbers in an automated manner.

A very advantageous formation of the plug connector makes provision for the housing to comprise two housing parts, which are slidable into each other and are lockable to each other by simultaneous contacting of the at least one single-core, insulated cable. In this way, the contacting and fixing of the single-core, insulated cable takes place simultaneously to the assembly of the two housing parts on each other.

In this regard, it is advantageously provided that the at least one spring or blade contact element together with the at least one insulation displacement contact rotated by 90° and the at least one clamping element following said insulation displacement contact are arranged in the first housing part and that the at least one single-core, insulated cable to be contacted and fixed is arranged in a cable duct in the second housing part such that it lies on the at least one insulation displacement contact prior to the two housing parts sliding into each other.

The two housing parts preferably have lock connection elements adapted to each other, in particular locking hooks. This enables a very quick and automated assembly by simply clipping the two housing parts into each other by simultaneous contacting and fixing of the at least one single-core, insulated cable.

The plug connector is particularly advantageous for the contacting and fixing of a plurality of single-core, insulated cables arranged lying adjacent to one another in the housing. To this end, it is provided that a plurality of spring or blade contact elements arranged in the housing are arranged lying adjacent to one another with the insulation displacement contacts and clamping elements assigned thereto.

A further aspect of the invention is a method for manufacturing a spring or blade contact element for a plug connector described above.

This method comprises the following steps:

For the manufacture of a component to be installed in the plug connector, the spring or blade contact element together with the at least one insulation displacement contact and together with the at least one clamping element are punched from a metal sheet in a punching process. In this case, the spring or blade contact element, the at least one insulation displacement contact and the at least one clamping element lie in the sheet metal plane. Then, the at least one insulation displacement contact and possibly the at least one clamping element are twisted in the sense of a torsion by substantially 90° from the sheet metal place in such a way that the at least one insulation displacement contact, the at least one clamping element are arranged one behind the other, wherein they are oriented and align in the plug direction with the spring or blade contact element. The whole component can thus be punched as a single punched part or, for example, also cut out by laser processing or cut out in another way from the metal sheet. The spring or blade contact element determined for the abovementioned plug connector is obtained by means of subsequent torsion of the at least one insulation displacement contact and the potentially at least one clamping element. The spring or blade contact element together with the at least one insulation displacement contact and the at least one clamping element, which can both be arranged on the abovementioned support, thus form a single metal component which is manufactured from a single piece of sheet metal and which, apart from the punching and torsion of the at least one insulation displacement contact and potentially the at least one clamping element, does not require any processing steps for manufacturing the at least one insulation displacement contact and the at least one clamping element and can also be manufactured in an automated manner to this extent. Potential processing steps with respect to the spring contact element can still be carried out additionally if required.

BRIEF DESCRIPTION OF THE DRAWINGS

Exemplary embodiments of the invention are depicted in the drawings and are explained further in the description below. They show.

DESCRIPTION OF THE EXEMPLARY EMBODIMENTS

Figure 1:
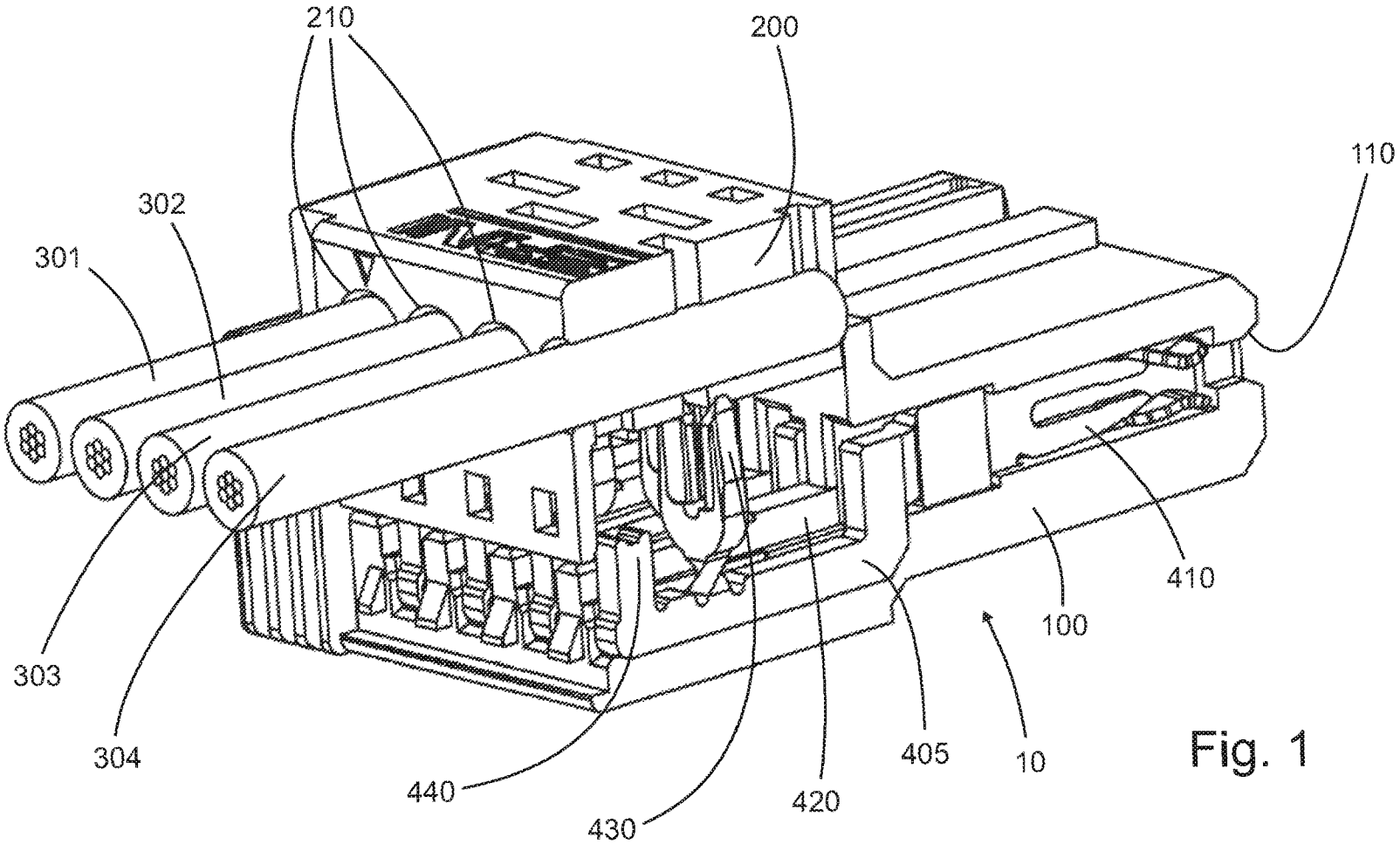
FIG. 1 an isometric depiction of a plug connector according to the invention for the contacting of a plurality of single-core, insulated cables arranged lying adjacent to one another prior to the assembly of the two housing parts on each other.

A plug connector designated as a whole with 10 has a housing which substantially consists of two parts, a first part 100 and a second part 200, which are lockable to each other. Spring contact elements 410 are arranged in the first part 100. Openings 110 are provided in the housing 100, through which blade contact elements (not shown) can be passed that are adapted to the spring contact elements 410 in an inherently known manner, in order to form an electrically conductive connection of the contact elements.

Figure 3:
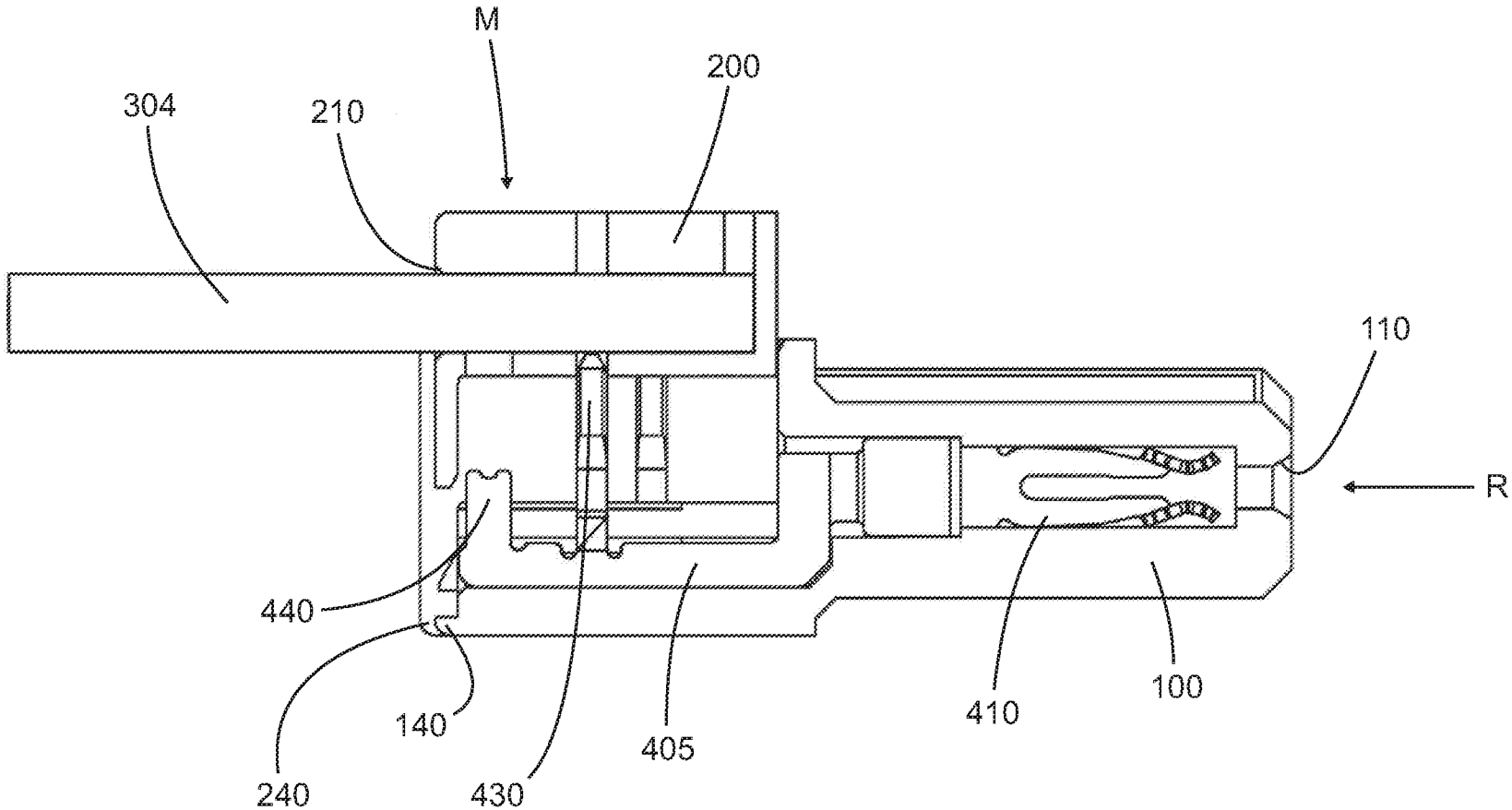
FIG. 3 a sectional depiction of the plug connector depicted in FIG. 1 and FIG. 2 prior to the assembly of the two housing parts on each other and FIG. 4 a sectional depiction of the plug connector depicted in FIG. 1 and FIG. 2 after the assembly of the two housing parts on each other.

A support 405 is integrally connected to the spring contact elements 410 (see also FIG. 3). An insulation displacement contact 430 is formed on the support 405, said insulation displacement contact being arranged perpendicularly to a plug direction R (FIG. 3) in order to contact and to fix a single-core, insulated cable 304. A clamping element 440 is also integrally connected to the support 405, said clamping element 440 being arranged on the side of the insulation displacement contact 430 facing away from the spring contact element 410 when seen in the plug direction R.

The spring contact element 410, the insulation displacement contact 430 and the clamping element 440 are initially punched out of a single sheet metal element. After the punching process, the spring contact elements 410, the insulation displacement contact 430 and the clamping element 440 lie in one plane. The insulation displacement contact 430 is then rotated by 90° out of this plane by means of twisting in the sense of torsion, as is depicted in FIG. 1, for example. The clamping element 440 is also manufactured by the punching process in this case. It can be unscrewed or twisted just like the insulation displacement contact 430 after the punching process by 90° out of the sheet metal plane (not shown). These method steps can also take place in an automated manner. The great advantage of this manufacturing process is that several insulation displacement contacts 430 and also several clamping elements 440 can be arranged one behind the other. By twisting from the sheet metal plane by 90°, a very simple manufacture of several insulation displacement contacts 430 lying one behind the other and several clamping elements 440 lying one behind the other is possible, wherein all insulation displacement contacts 430 and all clamping elements 440 are arranged in a line in the plug direction (R) (not shown).

At least one opening 210 is provided in the second housing 200, said opening being adapted to the single-core, insulated cable 304 and serves to accommodate the single-core, insulated cable 304. The single-core, insulated cable 304 is, in this regard, arranged in the second housing part 200 such that it lies on the insulation displacement contacts 430 prior to the assembly of the second housing part 200 to the first housing part 100. This state prior to the assembly is depicted in FIGS. 1 and 3.

The assembly now takes place such that the second housing part 200 is slid in a direction designated with M (see FIG. 3, FIG. 4) in the direction of the first housing part 100, wherein the insulation displacement contact 430 contacts and fixes the single-core, insulated cable 304 in an inherently known manner. To this end, the insulation displacement contact 430 cuts through the insulation shell of the single-core, insulated cable 304, partially also the core thereof, wherein it penetrates into the strands of the single-core, insulated cable and thus an electrically conductive connection is formed.

Figure 2:
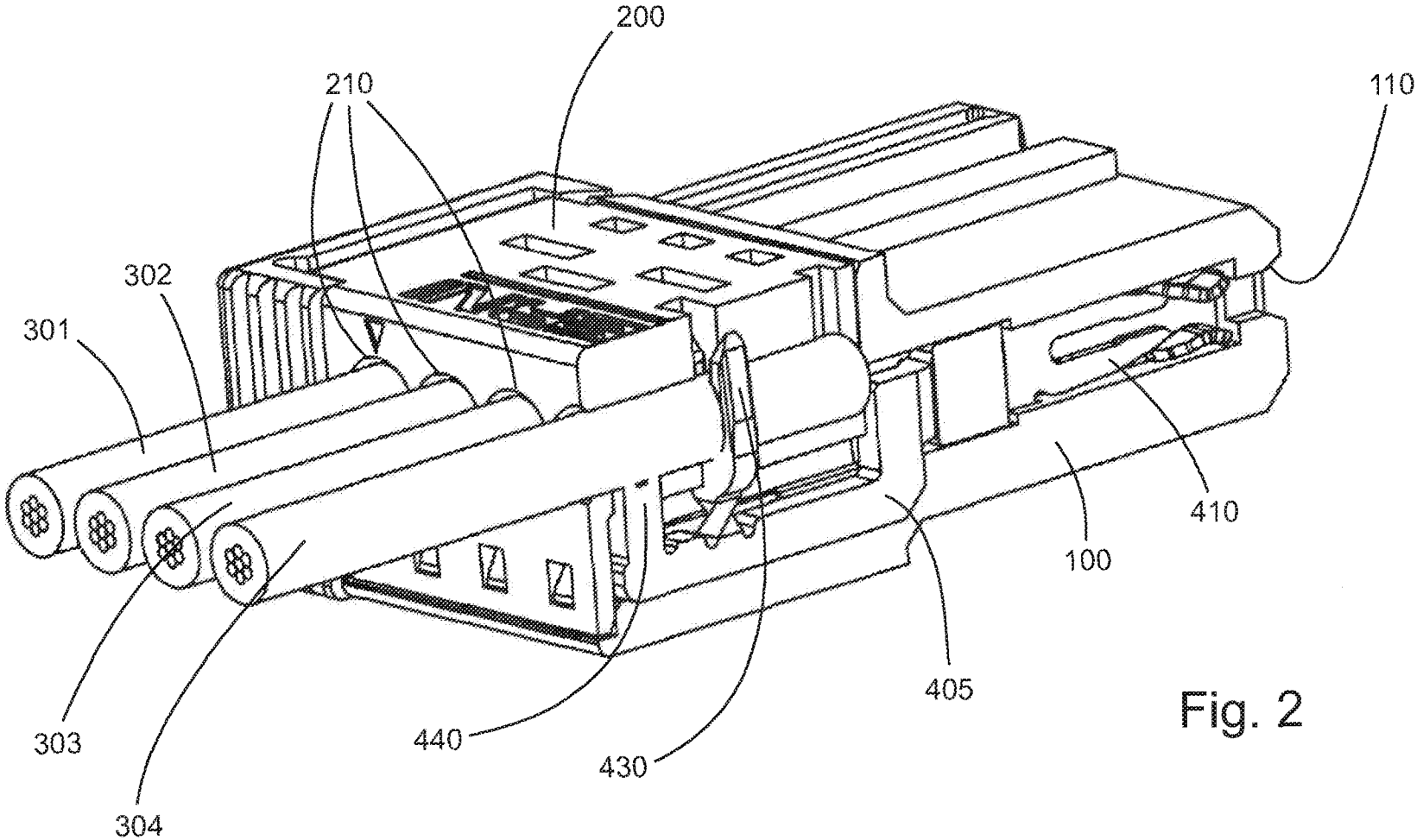
FIG. 2 an isometric depiction of the plug connector depicted in FIG. 1 after the assembly of the two housing parts on each other.
Figure 4:
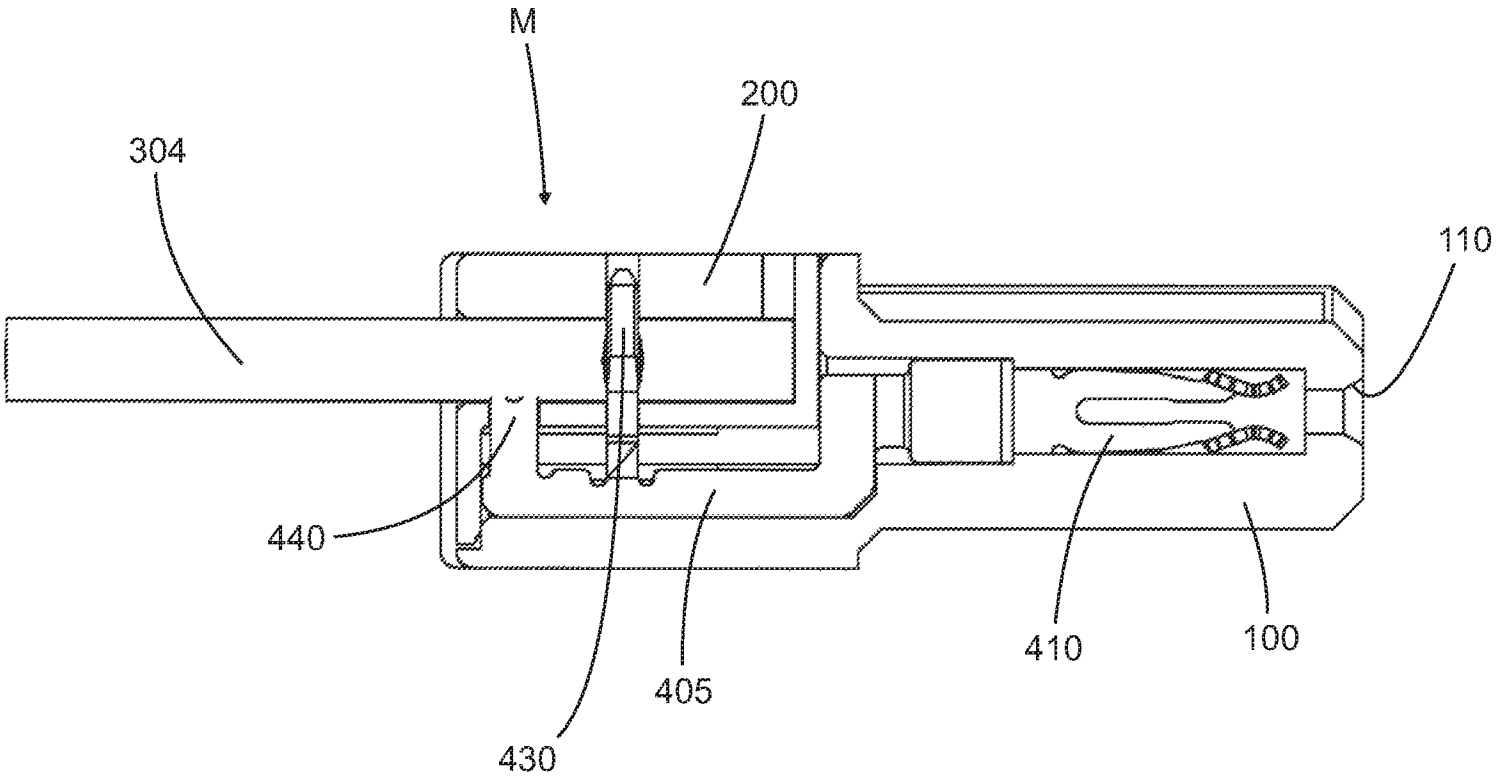

By sliding the two housing parts 200, 100 into each other, the cable 304 is also pushed onto the clamping element 440 and the clamping element 440 clamps the insulation shell of the cable 304. The clamping element 440 thus serves not only for the fixing of the cable 304, but also for strain relief. This state after the assembly is depicted in FIGS. 2 and 4.

The two housing parts have locking hooks 140, 240 adapted to each other, which lock into each other and thus hold the second housing part 200 on the first housing part 100.

The advantage of this assembly is that it is possible in a simple and automated manner. The plug connector enables the assembly of a plurality of single-core, insulated cables 301, 302, 303, 304 lying adjacent to one another in the manner previously described, wherein these cables are arranged in the plug direction R, thus have a collinear arrangement to the spring contact elements 410. The single-core, insulated cables 301, 302, 303, 304, to a certain extent, align with the insulation displacement contacts 410.

It is understood that instead of the insulation displacement contacts 410, blade contacts (not shown) can also be provided. It is also possible, purely in principle, to form not only one insulation displacement contact 430, but a plurality of insulation displacement contacts lying one behind the other on the support 405. More than one clamping element 440 can also be formed on the support.

A particular advantage consists in that the spring contact element 410, the support 405, the insulation displacement contact 430 and the clamping element 440 can be manufactured as a component from a single punched part, preferably with a single punching process. After the punching process, only the insulation displacement contact 430 has to be rotated by 90°. Such a manufacturing process is also possible in an automated manner. A great advantage also consists in that the clamping element 440 is formed as a metal part, which is integrally connected to the spring contact element 410, the insulation displacement contact 430 via the support 405. This substantially increases the tensile strength of the single-core, insulated cable(s) in the plug connector housing. The cable is, in this case, no longer held by a clamping element arranged on the housing, but rather by a clamping element which is connected to the spring contact element 410. In this way, clamping elements in the housing can be dispensed with, which also substantially simplifies the manufacture of the housing, while simultaneously increasing the stability.

The invention claimed is:

1. Plug connector having at least one spring or blade contact element arranged in a housing, said spring or blade contact element being connected in an electrically conductive manner to at least one insulation displacement contact which contacts and fixes at least one single-core, insulated cable, wherein a support is arranged on the side facing away from the spring or blade contact element, wherein on said support the at least one insulation displacement contact is arranged, wherein the at least one insulation displacement contact is arranged rotated by 90° relative to the spring or blade contact element such that the at least one single-core, insulated cable is contacted and fixed running in the plug direction through the insulation displacement contact, wherein the housing comprises two housing parts which are slidable into each other and are lockable to each other by simultaneous contacting and fixing of the at least one single-core, insulated cable, wherein the at least one single-core, insulated cable to be contacted and to be fixed is arranged in a cable duct in the second housing part such that it lies on the at least one insulation displacement contact prior to the two housing parts sliding into each other, wherein at least one clamping element is formed on the support on the side of the at least one insulation displacement contact facing away from the at least one spring or blade contact element, said clamping element, in the contacted and fixed state of the at least one single-core, insulated cable, clamping the insulation in order to form a strain relief, wherein the at least one spring or blade contact element together with the at least one insulation displacement contact and the at least one clamping element are arranged in the first housing part, wherein the at least one spring or blade contact element comprises a first contact arm and a second contact arm arranged symmetrically to the first contact arm across a first contact plane, wherein the at least one insulation displacement contact comprises a first arm and a second arm arranged symmetrically to the first arm across a second contact plane, and wherein the second contact plane is rotated by 90° with respect to the first contact plane.

2. Plug connector according to claim 1, wherein a plurality of insulation displacement contacts are arranged in a rotated manner.

3. Plug connector according to claim 1, wherein the at least one clamping element is arranged rotated by 90° relative to the spring or blade contact element in the plug direction of the spring or blade contact element.

4. Plug connector according to claim 1, wherein a plurality of clamping elements are arranged on the support.

5. Plug connector according to claim 1, wherein the spring or blade contact element, the support, the at least one insulation displacement contact, and the at least one clamping element form a single punched part.

6. Plug connector according to claim 1, wherein the two housing parts have lock connection elements adapted to each other, in particular locking hooks.

7. Plug connector according to claim 1, wherein a plurality of spring or blade contact elements arranged in the housing are arranged lying adjacent to one another with the insulation displacement contacts and clamping elements assigned thereto.

8. Method for manufacturing a component for a plug connector according to claim 1, comprising the following steps:

punching a spring or blade contact element, at least one insulation displacement contact, and at least one clamping element as one punched part from a metal sheet in a manner such that a first contact arm of the spring or blade contact element and a second contact arm of the spring or blade contact element are arranged symmetrically to each other across a first contact plane;

twisting the at least one insulation displacement contact from the sheet metal plane by torsion until it is substantially perpendicular to the metal sheet and is aligned with the spring or blade contact element in the plug direction and such that a first arm of the at least one insulation displacement contact and a second arm of the at least one insulation displacement contact are arranged symmetrically to each other across a second contact plane, the second contact plane being rotated by 90° relative to the first contact plane; and twisting the at least one clamping element from the sheet metal plane by torsion until it is substantially perpendicular to the sheet metal plane and is aligned with the spring or blade contact element in the plug direction.

* * * * *